US005640732A

United States Patent [19]

Diana et al.

[11] Patent Number: 5,640,732

[45] Date of Patent: Jun. 24, 1997

[54] WINDBREAK BARRIER FOR A SUSPENSION BRIDGE STRUCTURE, COMPRISING FLUTTER DAMPING MEANS

[75] Inventors: Giorgio Diana, Milan; Marzio Falco, Segrate, both of Italy

[73] Assignee: Stretto Di Messina S.p.A., Rome, Italy

[21] Appl. No.: 428,085

[22] PCT Filed: Oct. 27, 1993

[86] PCT No.: PCT/EP93/02986

§ 371 Date: Jul. 3, 1995

§ 102(e) Date: Jul. 3, 1995

[87] PCT Pub. No.: WO94/10387

PCT Pub. Date: May 11, 1994

[30] Foreign Application Priority Data

Oct. 28, 1992 [IT] Italy ..... M192A02465

[51] Int. Cl.[6] ..... E01D 11/00

[52] U.S. Cl. ..... 14/18; 14/19; 14/78

[58] Field of Search ..... 14/18, 19, 20, 14/21, 73, 77.1, 78

[56] References Cited

U.S. PATENT DOCUMENTS

| | | | |
|---|---|---|---|
| 2,333,391 | 11/1943 | Robinson et al. | 14/18 |
| 3,673,624 | 7/1972 | Finsterwalder et al. | 14/19 |
| 4,741,063 | 5/1988 | Diana | 14/18 |
| 5,287,578 | 2/1994 | Lovret | 14/18 |

*Primary Examiner*—James Lisehora
*Attorney, Agent, or Firm*—Young & Thompson

[57] ABSTRACT

Windbreak barrier for a suspension bridge comprising a substantially rigid flat structure, the top surface of which forms the roadway for the vehicles crossing the bridge, and a suspension system formed of catenary cables and of a plurality of vertical stays or hangers (P) to which is anchored the structure. The windbreak barrier comprises, on the one hand, aerodynamic elements consisting of a pair of horizontal wing surfaces (8, 9) having a symmetrical profile and forming part of a framework, and on the other hand, a vertical grille wall (910) having a transparency of the order of 70% and being mounted on the framework. The wing surfaces have a wing chord of 100 to 150 cm and a thickness, in correspondence of the highest point, of 20 to 30 cm.

7 Claims, 2 Drawing Sheets

WINDBREAK BARRIER FOR A SUSPENSION BRIDGE STRUCTURE, COMPRISING FLUTTER DAMPING MEANS

FIELD OF THE INVENTION

The present invention concerns suspension bridges comprising an essentially flat main structure, or framework, the top surface of which forms the roadway for the transport means crossing the bridge, and a suspension system formed of catenary cables anchored to end piers of the bridge and of a plurality of vertical stays or hangers to suspend the bridge framework to the catenary cables.

BACKGROUND OF THE INVENTION

As known, these suspension bridges have vibration frequencies of their own; normally, with no wind, the basic flexural vibration frequency differs from the basic torsional vibration frequency, both being generally very low. Nevertheless, the action of side winds varies said typical vibration frequencies, particularly because—especially in bridges with large transversal dimensions and/or a wide span, for instance motorway bridges—the flat suspended structure behaves, when actually exposed to side winds, similarly to a wing surface, hence with a "lifting" effect which greatly varies from one moment to the next.

As wind increases its strength, the two aforespecified vibration frequencies tend to approach, up to the point of coinciding: in these circumstances, the structure is thus subjected to so-called "flutter" conditions, i.e. to flexural-torsional stresses which may even result dangerous for the stability of the whole bridge.

These flutter conditions, and the problems connected therewith, are described in more detail in EP-A-0.233.528, filed by the same Applicant, to which reference is made for a better understanding of the present invention.

The main object of EP-A-0.233.528 is a wing structure, which is rigidly fixed to the lateral edges of the bridge and is meant to increase its flutter speed beyond the top speed of the wind expected in the bridge area.

The same EP-A-0.233.528 also discloses a windbreak barrier, whose main function is to reduce the crosswind pressure on the vehicles travelling along the bridge; such a barrier essentially consists of a grating, having a typically convex surface apt to cooperate with the wing structure, so as to control the action of the wind.

OBJECT OF THE INVENTION

The object of the present invention is to propose a windbreak barrier having a remarkable aerodynamic damping action on the bridge structure, such as to limit the use of additional wing structures, or even—at least in certain cases—give it up completely.

SUMMARY OF THE INVENTION

This result is essentially achieved due to the fact that said windbreak barrier comprises a grille wall, mounted onto a carrying framework formed of a plurality of uprights and of at least two ledgers, at least one of said ledgers consisting of an aerodynamic element formed as a wing surface with a substantially horizontal axis.

According to a preferred embodiment the invention, said wing surface has a wing chord of 100 to 150 cm and a thickness, in correspondence of its highest point, of 20 to 30 cm, while said grille wall has a transparency of about 70%.

BRIEF DESCRIPTION OF THE INVENTION

Further characteristics and advantages of the windbreak barrier according to the present invention will anyhow be more evident from the following description of a preferred embodiment thereof, illustrated by way of example on the accompanying drawing, in which.

Figure 1:
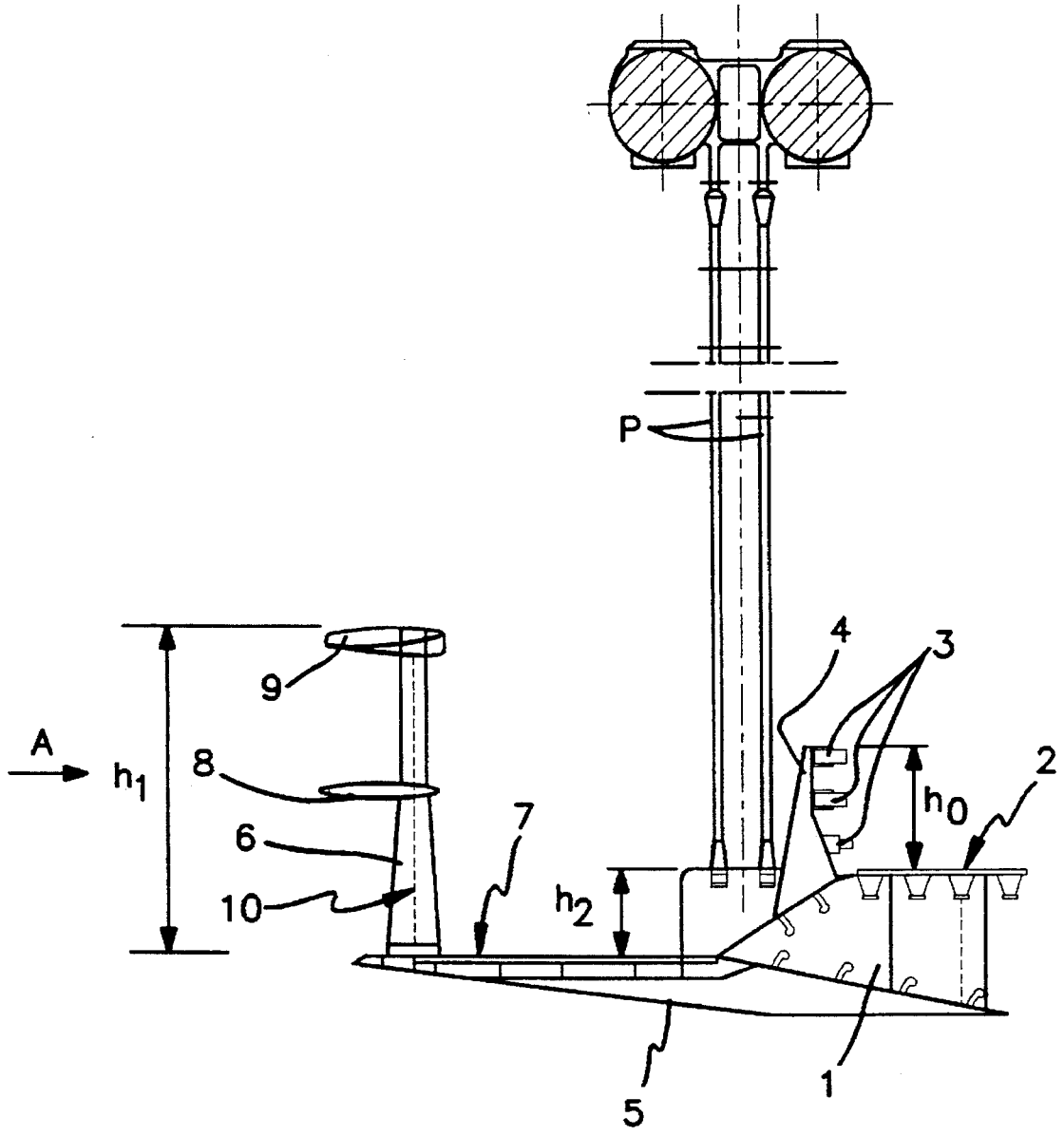
FIG. 1 is a diagrammatic, partial, cross-section view of the lateral edge of a bridge carrying a windbreak barrier according to the invention.
Figure 2:
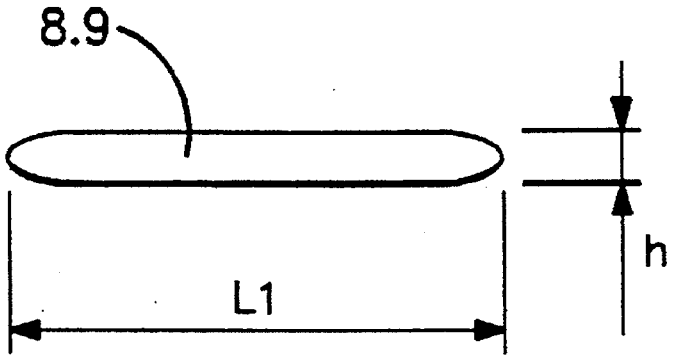
FIG. 2 is a diagrammatic, enlarged scale, cross-section view of one of the wing surfaces forming part of the windbreak barrier of FIG. 1.

The bridge structure to which the present invention refers substantially corresponds to that described in EP-A-0.233.528, whereby a detailed description thereof need not be given herein. FIG. 1 thus illustrates only the lateral edge 1 of the bridge, with the roadway 2 and the conventional guardrails 3, fixed on uprights 4 the height $h_0$ of which may vary between 1 and 1.5 m. The hangers P to suspend the bridge framework are connected to an anchor plate P1 fixed to the edge 1.

As also shown in FIG. 1, to the edge 1 there are fixed, at regular intervals, arms 5 outwardly projecting from the bridge and supporting, at their free end, uprights 6; the arms 5 also carry surface gratings 7 forming a service lane.

According to the present invention, on the uprights 6 there are fixed ledgers 8 and 9 forming therewith a framework to support a grille wall 10 acting as windbreak barrier. As clearly shown on the drawing, said ledgers 8 and 9 are shaped as a wing surface.

The height $h_1$ of the uprights 6 is such that their top is at a level more or less corresponding to the highest of the vehicles supposed to cross the bridge. For instance the height $h_1$ of the uprights 6 may be of about 4 to 5 m from the level of the service lane surface 7, which latter may find itself at a height $h_2$ of about 1 m below the level of the roadway 2.

The wing surface 9 is fixed at the top of the uprights 6, while the wing surface 8 is fixed at about half-way along said uprights. These wing surfaces preferably have a symmetrical section in respect of both their vertical and horizontal axes; the wing chord $L_1$ of such wing surfaces is of 1 to 1.5 m, and their thickness in correspondence of the highest point is of 20 to 30 cm.

The windbreak grille wall 10 is preferably mounted directly on the framework formed by the uprights 6 and ledgers 8, 9, and is thus positioned perfectly vertical, as shown on the illustrated embodiment. It is however possible to mount said wall 10 with additional support elements—for instance in the form of ribs (not shown)—apt to give to its surface an arcuate or anyhow profiled configuration, allowing a better control over the wind stream.

Figure 3:
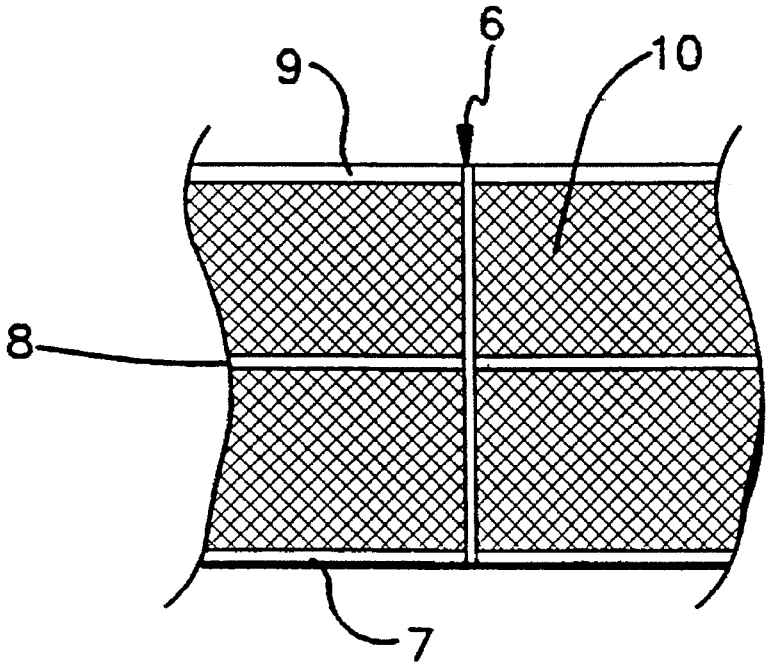
FIG. 3 is a partial side view of the barrier, in the direction of arrow A in FIG. 1.

The grille wall 10, shown in FIG. 3, has a transparency (ratio between mesh-holes surface and overall surface) of the order of 70%.

Practical tests carried out in a wind tunnel, on a dynamic model of the bridge according to the described embodiment, have allowed to ascertain an optimal behaviour both as far as protecting the traffic from wind gusts and, above all, as far as damping the flutter phenomena.

In practice, the windbreak barrier according to the invention is apt to produce a damping effect allowing to settle the wind stream just in a position in which—owing to the bridge configuration and to the traffic—turbulence conditions may more easily arise.

The tests carried out in a wind tunnel have shown, in particular, that the flutter speed is of the order of 90 m/sec (while the arrangement according to the cited EP-A-0.233.528 allowed to obtain flutter speeds not exceeding 70 m/sec).

It is interesting to note, moreover, the improved efficiency of the structure according to the present invention: the wing profiled ledgers 8, 9, have in fact a considerably reduced surface—by about a quarter—compared to the wing surface of EP-A-0.233.528; in spite of this, as said, they allow to increase the flutter speed.

As well as an optimal behaviour from the functional point of view, the windbreak barrier according to the invention provides an additional advantage from the constructive point of view—in respect of a system as that described in EP-A-0.233.528—in that its construction costs are far lower and its assembly is far easier: said barrier can in fact be constructed into separate, prefabricated sections. Another considerable advantage lies in the fact that the windbreak grille wall can be constructed flat and can be supported directly by the uprights 6 and ledgers 8, 9, thus, without having to necessarily provide for special arc-shaped supporting ribs.

It is anyhow understood that the invention is not limited to the heretofore described and diagrammatically illustrated embodiment, and that there may be other embodiments, differing from the same, all within easy reach of an expert of the art, but all obviously falling within the scope of the above inventive idea, as defined in the following claims.

We claim:

1. A suspension bridge structure having a windbreak barrier, comprising a suspension system formed of catenary cables and of vertical stays or hangers (P); a substantially rigid flat framework anchored to said suspension system; and aerodynamic elements rigidly fixed to the bridge structure to control the action of the wind on said structure; said windbreak barrier comprising a grille wall (10), a framework formed of a plurality of uprights (6) and at least two ledgers (8, 9), said grille wall (10) being mounted on said framework, at least at one of said ledgers consisting of an aerodynamic element formed as a wing surface with a substantially horizontal axis.

2. A suspension bridge structure as claimed in claim 1, wherein said wing surface has a wing chord of 100 to 150 cm and a maximum thickness of 20 to 30 cm.

3. A suspension bridge structure as claimed in claim 1, wherein said grille wall (10) has a transparency of about 70%.

4. A suspension bridge structure as claimed in claim 1, wherein said ledgers (8, 9) are formed as wing surfaces with a symmetrical profile and are parallel to each other.

5. A suspension bridge structure as claimed in claim 4, wherein said ledgers (8, 9) have a horizontal longitudinal plane of symmetry.

6. A suspension bridge structure as claimed in claim 4, wherein said wing surfaces are positioned one (9) at the top of the grille wall (10) and the other (8) about half way of the height of said grille wall (10).

7. A suspension bridge structure as claimed in claim 1, wherein the height of the windbreak barrier is 4 to 5 meters.

* * * * *